US005971835A

United States Patent [19]

Kordonski et al.

[11] Patent Number: 5,971,835

[45] Date of Patent: Oct. 26, 1999

[54] SYSTEM FOR ABRASIVE JET SHAPING AND POLISHING OF A SURFACE USING MAGNETORHEOLOGICAL FLUID

[75] Inventors: William I. Kordonski; Donald Golini, both of Rochester; Stephen Hogan, Rush; Arpad Sekeres, Rochester, all of N.Y.

[73] Assignee: QED Technologies, Inc., Rochester, N.Y.

[21] Appl. No.: 09/047,664

[22] Filed: Mar. 25, 1998

[51] Int. Cl.[6] ..... B24B 1/00

[52] U.S. Cl. ..... 451/38; 451/9; 451/36; 451/60; 451/91; 451/93

[58] Field of Search ..... 451/2, 36, 60, 451/91, 93

[56] References Cited

U.S. PATENT DOCUMENTS

| | | | |
|---|---|---|---|
| 4,680,900 | 7/1987 | Wadephul et al. | 451/2 |
| 5,449,313 | 9/1995 | Kordonsky et al. | 451/35 |
| 5,452,745 | 9/1995 | Kordonski et al. . | |
| 5,525,249 | 6/1996 | Kordonsky et al. | 252/62.56 |
| 5,577,948 | 11/1996 | Kordonsky et al. | 451/35 |
| 5,616,066 | 4/1997 | Jacobs et al. . | |

OTHER PUBLICATIONS

Entov et al. "On capillary instability of jets of magneto–rheological fluids", The Society of Rheology, Inc., pp.727–739, Sep./Oct. 1996.

*Primary Examiner*—David A. Scherbel
*Assistant Examiner*—Shantese McDonald
*Attorney, Agent, or Firm*—Harris Beach & Wilcox LLP.

[57] ABSTRACT

A fluid having magnetorheological (MR) properties and including a finely-divided abrasive material is directed through a non-ferromagnetic nozzle disposed axially of the helical windings of an electric solenoid. The MR fluid may contain magnetosoft or magnetosolid particles or mixtures thereof. A magnetic field created by the solenoid orients and aligns the magnetic moments of the particles to form fibrils thereby stiffening the flowing MR fluid which, when ejected from the nozzle, defines a highly-collimated jet. Collimation of the MR material persists for a significant time outside the magnetic field, permitting use of the abrasive jet to shape and/or polish the surface of a workpiece at some distance from the nozzle. The jet is directed into a shroud against a workpiece mounted for multiple-axis rotation and displacement to meet predetermined material removal needs for shaping. The solenoid may be similarly mounted to also move the jet over the surface of the workpiece. The apparatus may be provided with a plurality of independently-powerable electromagnets disposed in a plane orthogonal to the jet for deflecting the jet as desired to a specific target area on the workpiece or to move over the surface of the workpiece in a complex, predetermined pattern. The shapes and locations of anomalies to be removed may be pre-programmed into a computer-operated controller which calculates and controls the intensity and dwell time of the jet as it traverses repeatedly over the workpiece to achieve the desired result.

17 Claims, 2 Drawing Sheets

SYSTEM FOR ABRASIVE JET SHAPING AND POLISHING OF A SURFACE USING MAGNETORHEOLOGICAL FLUID

BACKGROUND OF THE INVENTION

1. Field of the Invention

The present invention relates to methods and apparatus (a system) for shaping and polishing (finishing) a surface, more particularly to methods and apparatus for shaping and polishing a surface by the impingement of an abrasive jet, and most particularly to methods and apparatus for shaping and polishing a surface by the impingement of a magnetically-modifiable and magnetically-directable jet.

2. Discussion of the Related Art

Water jets containing abrasive particles are known to be used for cutting or shaping materials such as glass, ceramics, plastics and metals. This technology is known generally as abrasive stream finishing, or abrasive suspension jet machining, or abrasive flow machining. Typically, such jets are impinged upon the substrate to be cut at a relatively high velocity, which may exceed 10 meters per second. When the jet strikes the impact zone, the abrasive particles in the water carrier chip away particles of the substrate surface. The rate of material removal is a function of the kinetic energy of the jet, the sharpness, size, and hardness of the abrasive particles the material of the substrate, the distance from the jet nozzle to the workpiece, and the angle of incidence of the jet.

It has been difficult in practice to adapt abrasive liquid jet technology for precision finishing of surfaces of highly-demanding objects such as, for example, optical components. A fundamental property of a fluid jet is that it begins to lose its collimation as the jet exits a nozzle, due to a combination of abruptly imposed longitudinal and lateral pressure gradients, surface tension forces, and aerodynamic disturbance. A water jet tends immediately to spread out and to break into droplets within a short distance of a nozzle, typically within a few nozzle diameters of the nozzle orifice, increasing thereby the cross-sectional area of the jet and proportionally decreasing the unit kinetic energy within the jet. For this reason, the nozzle of an abrasive cutting jet typically is situated as close as is practical to the workpiece to be cut. Reducing pressures and flow rates to place the jet in a flow regime where it can polish rather than cut also serves to degrade the jet further so that it is not readily concentratable on a small area of the workpiece. Increasing the viscosity of the cutting medium by addition of viscosity-building agents can help to stabilize the jet but also proportionally increases the resistance to fluid flow in the delivery system and the pumping power required to deliver the fluid to the nozzle, making impractical a high speed, high-viscosity jet for either cutting or polishing.

A further limitation of using an abrasive water jet for polishing is that the jet is positionable against the workpiece only by adjusting either the attitude of the nozzle or the position of the workpiece. The jet itself cannot be redirected or guided once it leaves the nozzle orifice.

SUMMARY OF THE INVENTION

It is a principal object of the invention to provide a fluid jet which retains collimation and coherence over a distance of many nozzle diameters from a nozzle orifice.

It is a further object of the invention to provide a collimated fluid jet which can be extruded from a nozzle at high velocity.

It is a still further object of the invention to provide a collimated jet of fluid having high apparent viscosity.

It is a still further object of the invention to provide a coherent fluid jet which can be redirected after leaving a nozzle.

It is a still further object of the invention to provide a high-speed, well-collimated fluid jet including abrasive particles which can be used for shaping and/or polishing a substrate surface.

It is a still further object of the invention to provide a system for shaping and/or polishing a substrate surface by the action of a high-speed, well-collimated, remotely-redirectable abrasive fluid jet.

These objectives may be provided by use of a "controllable" fluid, for example, a magnetorheological (MR) fluid.

Briefly described, a fluid which can undergo selectable increases in viscosity by imposition of a magnetic field is said to be a magnetorheological fluid. Examples of MR fluids suitable for use in the present invention are disclosed in U.S. Pat. No. 5,525,249 issued Jun. 11, 1996 to Kordonsky et al., which is incorporated herein by reference. MR fluids, such as those supplied as VersaFlo™ MR Series Fluids by Lord Corporation, Cary, N.C. USA, exhibit the ability to form particle fibrils and to develop a high yield stress (become essentially solid) upon application of a magnetic field. The fibrils align with the force lines of the magnetic field. MR fluids are well known in a variety of "controllable fluid" devices such as dampers, clutches, brakes, valves, and mounts, wherein in the absence of an applied magnetic field the fluids have low intrinsic viscosity and can flow freely through the gap between two plates but acquire a high apparent viscosity (high yield stress) when a field is applied across the plates. The yield stress and viscosity changes, however, are anisotropic: no change in properties occurs in the direction parallel to lines of the magnetic field, and maximum change occurs in the direction orthogonal to the lines of the magnetic field. For this reason, the properties are said to be "selectable" and "controllable" by selecting and controlling the direction and magnitude of the magnetic field to be imposed. Note also that the selectable viscosity changes afforded by MR fluids are rapidly reversible by reduction or elimination of the imposed magnetic field.

In the present invention, a continuous stream of an MR fluid is directed through a non-ferromagnetic tube disposed axially of the helical windings of an electric solenoid. Preferably, the MR fluid is combined with a finely-divided abrasive material, for example, cerium oxide, diamond dust, or iron oxide, such that the abrasive is at least temporarily suspended therein. Flow of electricity through the solenoid creates a magnetic field which forms field-oriented structure of fibrils from the magnetic particles and thereby stiffens the flowing MR fluid into a virtually solid rod which manifests a very high yield stress when sheared perpendicularly to the direction of flow and a low shear stress when sheared in the direction of flow, as along the wall of the tube. Such anisotropic fibrillation allows the stiffened fluid to flow easily through the tube without requiring high pumping pressures as would be required for a conventional, isotropically high-viscosity fluid. The tube defines a nozzle, which may have a specially-shaped exit orifice which may be smaller in diameter than the tube itself. The MR rod ejected from the nozzle defines a highly-collimated, substantially solid jet of MR fluid. Upon leaving the nozzle, the MR fluid jet passes beyond the solenoid's magnetic field, and anisotropic fibrillation within the jet gradually begins to decay. However, remanent high viscosity, and thus consequent stabilization of the MR jet, can persist for a sufficient time that the jet may travel up to several feet without significant spreading and loss of structure. This permits use of the abrasive jet to shape and/or polish the surface of a workpiece at some distance from the nozzle.

Magnetorheological fluids suitable for use in the present invention may comprise solely magnetically "soft" particles, or solely magnetically "solid" particles, or mixtures of the two. Mixtures preferably comprise a major portion of hard particles and a minor portion of soft particles.

Magnetosoft particles are defined as having multiple magnetic domains, typically thousands of such domains, which are alignable by a magnetic field but which are randomly oriented in the absence of a magnetic field. Magnetosoft particles do not retain magnetic orientation in the absence of an imposed magnetic field. Examples of magnetosoft materials are iron, carbonyl iron, and alloys of iron with cobalt and nickel.

Magnetohard particles are defined as having a single magnetic domain which is alignable by a magnetic field. Such particles are typically acicular, permitting, as in the manufacture of magnetic recording materials, physical alignment of the particles by a magnet. The polarity of any domain may then be reversed by imposition of a reversed magnetic field, and the reversed polarity is retained when the field is removed, as in the recording of bits in a magnetic recording device.

Examples of magnetohard materials are γ-iron oxide and chromium dioxide.

In a preferred embodiment, the jet is directed into a shroud surrounding a workpiece to be finished. The remanent hardness of the jet causes the abrasive particles to be aggressively impinged on the workpiece. The workpiece may be mounted for multiple-axis rotation and displacement to meet the predetermined material removal needs of the workpiece. Additionally, the solenoid may be similarly mounted to move the jet over the surface of the workpiece.

Further, in a presently preferred embodiment, the apparatus of the invention may be provided with a plurality of independently-powerable electromagnets, preferably four disposed at the corners of a square included in a plane orthogonal to the jet at a location in space between the nozzle exit orifice and the surface of the workpiece. The magnets may be driven dynamically by known means to cause the jet of magnetically-responsive stiffened fluid to be deflected as desired to a specific target area on the workpiece or to move over the surface of the workpiece in a complex, predetermined pattern.

The intensity of abrasive attack on the workpiece is very highly controllable because the shape, location, and apparent viscosity of the jet at the work surface can be controlled by controlling the solenoid magnet, directing magnets, fluid temperature, and pump pressure (flow rate). This permits programmed shaping and/or polishing of a surface of a blank, for example, a lens blank. The actual shape and roughness of the blank surface is determined before polishing begins, preferably and for example, by known interferometric techniques, and is compared to a desired final shape and surface smoothness. The shapes and locations of the anomalies to be removed are programmed into a computer-operated controller which calculates and controls the intensity and dwell time of the jet as it traverses over the workpiece to achieve the desired result.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
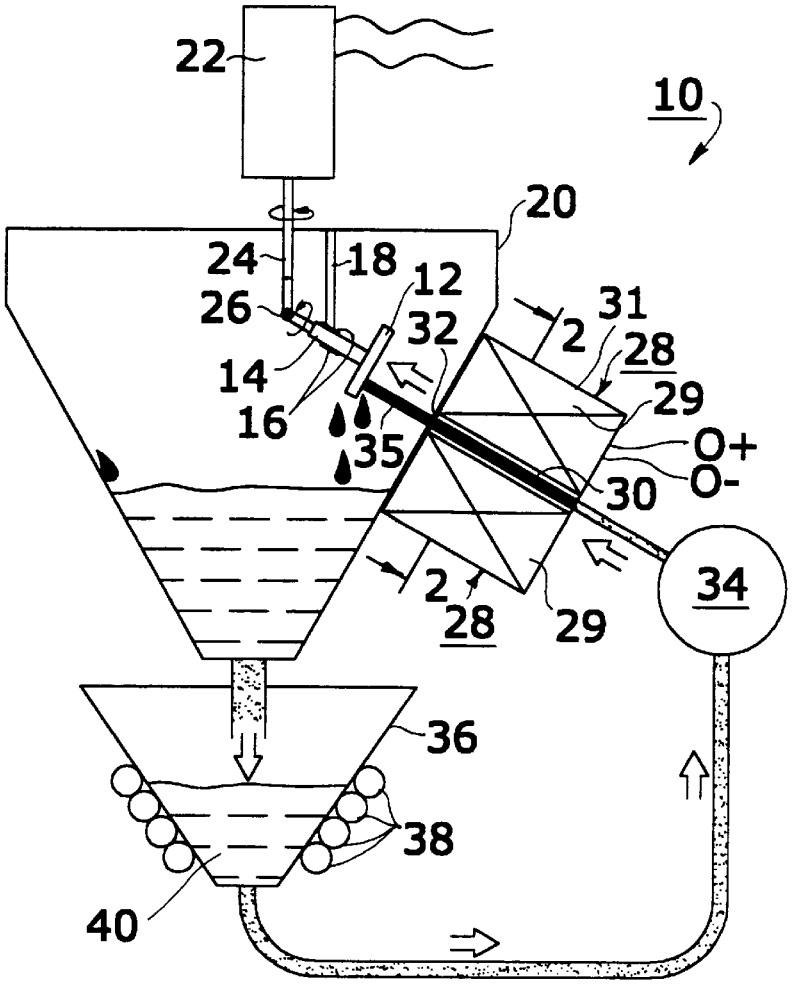
FIG. 1 is a partially schematic, cross-sectional, elevational view of an apparatus in accordance with the invention, the shown apparatus being in operation.
Figure 2:
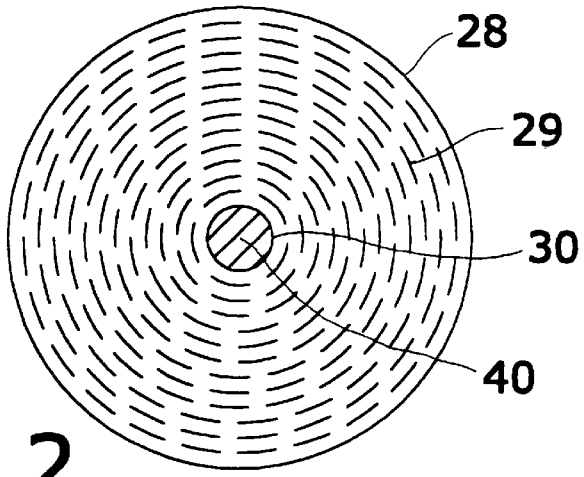
FIG. 2 is a cross-sectional view taken along line 2—2 in FIG. 1.

Referring to FIGS. 1 and 2, there is shown an embodiment 10 of an apparatus in accordance with the invention. A workpiece 12 to be finished (shaped and/or polished) is mounted in a supportive chuck 14, which in turn is supported for rotation in bearings 16 of bearing mount 18. The workpiece may be, for example, a molded blank for a glass or plastic lens or other optical element, or a similar metal or ceramic element requiring a very high level of accuracy in its final shape and the smoothness of its surface. The working flexibility of the system, as described below, permits the workpiece to have a non-regular, asymmetric form if so desired.

The workpiece, bearings, and bearing mount are surrounded by a shroud 20 which serves as a supportive housing and shield for the finishing operations. Outside the shroud is a multi-axis positioner 22, for example, a 5-axis CNC machine available from Boston Digital Corp., Milford, Mass. USA, the output shaft 24 of which is connected through an opening in shroud 20 to chuck 14 and may include a universal joint 26. Positioner 22 preferably is programmable to rotate and/or translate workpiece 12 through any desired series of orientations during the finishing operation. Preferably, the shape of the workpiece is characterized, as by laser interferometry, before the workpiece is mounted for finishing, and a three-dimensional map is generated of the areas to be removed. Instructions for workpiece motions to achieve this removal are entered into the CNC positioner. Alternatively, the workpiece may be scanned during finishing and results fed back to the positioner in real time.

An electric solenoid 28 capable of generating an axial magnetic field of, for example, about 1000 gauss is mounted such that an extension of the solenoid's axis in space intersects a portion of the surface to be finished on workpiece 12. Preferably, the electric current provided to solenoid 28 may be varied to vary the strength of the magnetic field as desired. Solenoid 28 is wound conventionally with electrically conductive windings 29 preferably contained within a magnetically opaque shell 31 formed of, for example, steel. Solenoid 28 is provided along its axial length with a tube which defines a nozzle 30. The tube is formed of a non-ferromagnetic material such as, for example, glass, ceramic, or a Series 300 stainless steel. Solenoid 28 may be mounted within or outside the shroud, the latter position being preferable for housekeeping reasons. Nozzle 30 communicates with the interior of shroud 20 through an aperture 32. A pump 34 is connected for fluid flow between a fluid reservoir 36 and nozzle 30. Preferably, reservoir 36 is provided with controllable cooling means such as a conventional cooling coil 38 to temper the working fluid. Reservoir 36 contains an amount of a magnetorheological (MR) fluid 40 which preferably includes a finely-divided abrasive material such as, for example, cerium oxide, diamond dust, alumina, or combinations thereof.

In operation, MR fluid, which has a low inherent viscosity, is drawn from the reservoir by the pump and pumped through the nozzle in the solenoid. When the MR fluid enters the solenoid axial magnetic field in the nozzle, the magnetic moments of the magnetic particles become aligned to form fibrils, inducing a rod-like structure in the fluid. The fluid becomes highly stiffened to a physical texture like wet clay, and the apparent viscosity across the direction of flow becomes very high. The stiffened fluid is ejected from the nozzle in the direction of the workpiece as a rod-like, highly collimated jet 35. Upon passing out of the solenoid magnetic field, the jet retains its induced anisotropic structure and residual "memorized" rheological properties which damp degrading aerodynamic forces on the jet and also work against degrading surface tension forces. Remanent anisotropy is enhanced in the preferred embodiment by use of magneto-opaque shell 31 for solenoid 28. All lines of magnetic force are thus retained within the shell. The fringing magnetic field which extends axially beyond the windings of a non-shielded solenoid is progressively divergent can undesirably reduce remanent anisotropy in the jet. As a result, the jet can remain coherent at a relatively great distance from the nozzle. Because magnetosolid particles retain their imposed polarity, MR fluids containing magnetosolid particles maintain fibril structure beyond the nozzle to a substantially greater degree than do those containing only magnetosoft particles.

The MR fluid is impinged continuously onto the workpiece, which is driven by the positioner through a pre-programmed series of motions to present portions of the workpiece surface sequentially to the jet for abrasion. The tight jet coherence provides very high efficiency, selectivity, and control in material removal. MR fluid deflected from the workpiece is collected in the shroud and conveyed back to the reservoir for tempering and reuse.

Figure 3:
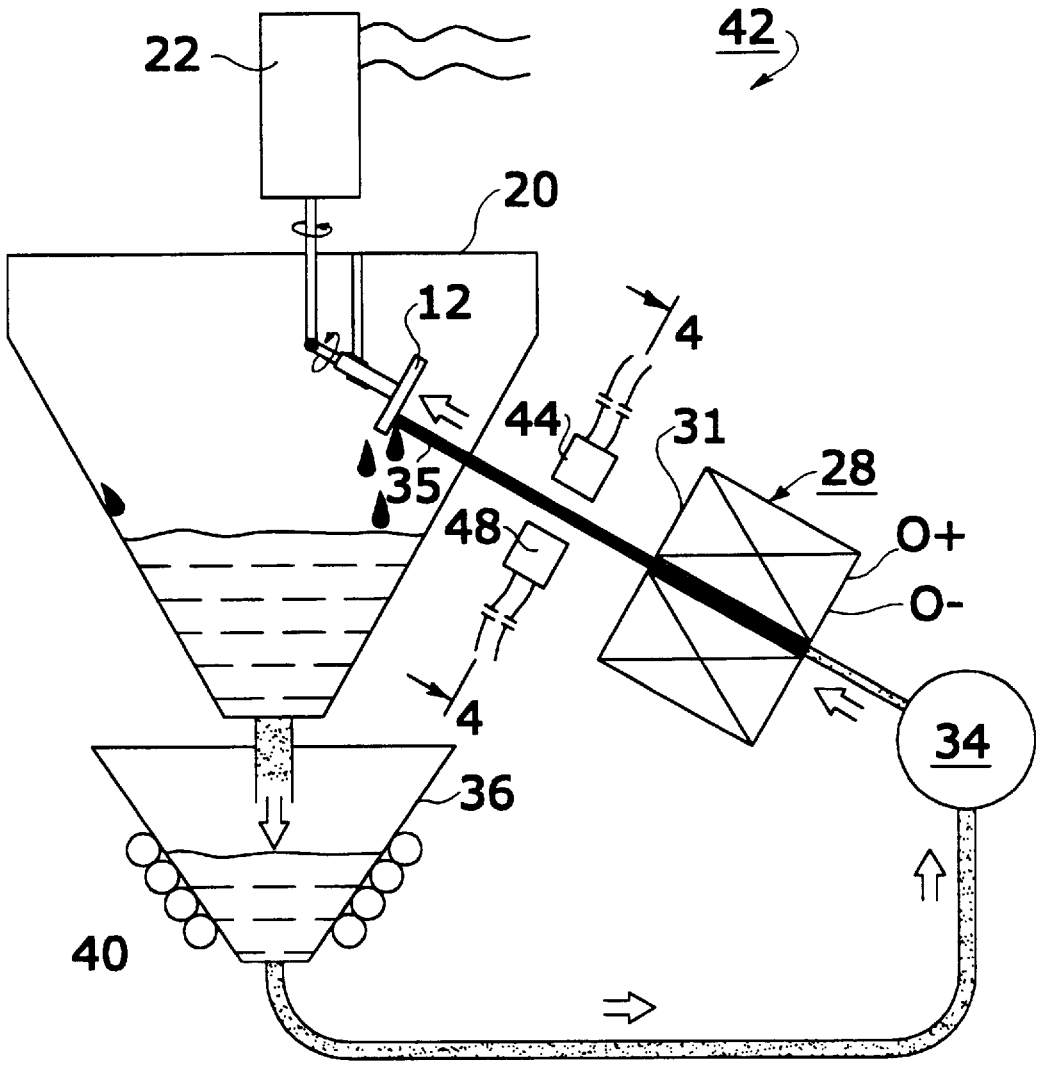
FIG. 3 is a view like that shown in FIG. 1 of a further embodiment of the invention, showing the addition of jet-steering magnets.
Figure 4:
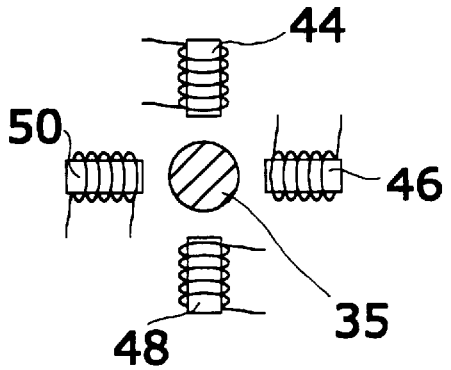
FIG. 4 is a cross-sectional view taken along line 4—4 in FIG. 3.

Referring to FIGS. 3 and 4, a second embodiment 42 is similar to first embodiment 10 except that the solenoid is spaced apart from the shroud to permit disposition of a plurality of field magnets around the stiffened jet 35 as it passes from the nozzle 30 to the workpiece 12. Preferably, there are four such magnets 44, 46, 48, and 50 disposed at the corners of a square contained within a plane orthogonal to the flow direction of the jet. The magnets may be connected and driven in known fashion (similar to the electromagnetic steering of an ion beam or cathode ray) to apply a resultant magnetic gradient across the jet to change the trajectory of the jet. The gradient may be dynamically varied in magnitude and direction as desired to provide a two-dimensional scanning of the jet over the surface of the workpiece during finishing.

Example

In an apparatus as shown in FIG. 1, MR fluid having a viscosity of 500 cp and containing 36 volume % carbonyl iron, 6 volume % cerium oxide, 55 volume % water, and 3 volume % stabilizers was pumped using a Hydra-Cell diaphragm pump, model M-03 (Wanner Engineering, Inc., Minneapolis, Minn. USA) at a flow rate of about 4 liters/min to provide a nozzle jet velocity of 10 meters/second. The nozzle was located along the 12.5 mm bore of a solenoid having 1600 turns, which solenoid generated a magnetic field of 1 kgauss. The nozzle orifice was 3.55 mm in diameter, was flush with the solenoid face, and was mounted flush with the outside of the aperture in the shroud. A workpiece of flat BK7 glass was mounted in the chuck to provide a jet incidence angle of 90°.

Results

1. The workpiece was stationary and was exposed to the jet treatment on a spot for 15 minutes with a solenoid current of 1.5 amperes. The spot was analyzed by interferometry before and after polishing. The peak rate of glass removal was 0.0785 $\mu$m/min, and the removal function had a profile characteristic of the fluid velocity profile at the zone where the fluid flows after jet collision with the stationary workpiece surface.

2. The spindle speed was set at 200 rpm and a resulting ring was polished on the surface of the glass for 1 hour. After polishing, roughness in the ring and roughness outside the ring were measured by Chapman profilometer. The surface finish in the ring was improved to an RMS value in the range of 20–40 Angstroms.

From the foregoing description it will be apparent that there has been provided an improved system for abrasive-jet finishing of precision elements, wherein a magnetorheological fluid containing abrasive particles is stiffened to a high apparent viscosity in a solenoid's internal magnetic field, ejected at a high velocity from a nozzle, and impinged as a coherent, collimated jet upon the surface to be finished. Variations and modifications of the herein described magnetorheological abrasive jet finishing system, in accordance with the invention, will undoubtedly suggest themselves to those skilled in this art. Accordingly, the foregoing description should be taken as illustrative and not in a limiting sense.

What is claimed is:

1. A method of making a coherent, substantially rigid fluid jet comprising the steps of:

a) providing an electric solenoid having an axis and having an axial tube formed of non-magnetic material, said tube defining a nozzle for said jet;

b) providing a magnetorheological fluid;

c) energizing said solenoid to provide a magnetic field having field lines passing through said nozzle tube substantially parallel to said axis of said solenoid;

d) pumping said magnetorheological fluid through said nozzle to stiffen said fluid in the presence of said magnetic field; and e) ejecting said stiffened fluid from said nozzle to form said jet.

2. A method in accordance with claim 1 wherein said magnetorheological fluid comprises magnetic particles selected from the group consisting of magnetosoft, magnetosolid, and mixtures thereof.

3. A method in accordance with claim 2 wherein said magnetosoft particles contain a plurality of magnetic domains and are selected from the materials group consisting of iron, carbonyl iron, magnetite, alloys of iron with cobalt and nickel, and mixtures thereof.

4. A method in accordance with claim 2 wherein said magnetosolid particles contain a single magnetic domain and are selected from the materials group consisting of γ-iron oxide, chromium dioxide, and mixtures thereof.

5. A method in accordance with claim 2 wherein said mixture includes a major portion of said magnetosolid particles and a minor portion of said magnetosoft particles.

6. A method in accordance with claim 1 wherein said magnetorheological fluid contains abrasive material.

7. A method in accordance with claim 6 wherein said abrasive material is selected from the group consisting of cerium oxide, diamond dust, alumina, and mixtures thereof.

8. A method in accordance with claim 1 comprising the further steps of:

a) providing at least one variably-energizable electromagnet adjacent the path of said jet; and b) energizing said electromagnet to form a magnetic field in said path of said jet, said field having lines substantially orthogonal to said path.

9. A method in accordance with claim 8 further comprising a plurality of independently-energizable electromagnets.

10. A method in accordance with claim 9 comprising four electromagnets, a one of said four magnets being disposed at each corner of a square, and said square being included in a plane substantially orthogonal to said jet path.

11. A method of deflecting a jet of magnetorheological fluid, comprising the steps of:

a) providing four independently- and variably-energizable electromagnets, a one of said four magnets being disposed at each corner of a square, and said square being included in a plane substantially orthogonal to said jet path; and b) energizing said electromagnets to form a magnetic field in said path of said jet, said field having lines substantially orthogonal to said path.

12. A system for finishing a workpiece by impinging a magnetorheological fluid jet thereon, comprising:

a) a fixture for holding said workpiece;

b) an electric solenoid spaced apart from said workpiece and having an axis directed toward said workpiece and having an axial tube formed of non-ferromagnetic material, said tube defining a nozzle for said jet, said solenoid being energizable to provide a magnetic field having field lines passing through said nozzle tube substantially parallel to said axis of said solenoid;

c) a magnetorheological fluid; and d) pump means for delivering an amount of said fluid into said nozzle in said magnetic field to magnetically stiffen said fluid therein and for subsequently ejecting a jet of said stiffened magnetorheological fluid from said nozzle to impinge upon said workpiece.

13. A system in accordance with claim 12 further comprising means for controllably moving said fixture in a plurality of modes to vary the location of said impingement of said stiffened fluid upon said workpiece.

14. A system in accordance with claim 12 further comprising a recirculating system for said magnetorheological fluid, including:

a) a shroud around said workpiece for collecting said fluid after impingement on said workpiece, said shroud having an aperture for entry of said jet from said nozzle;

b) a reservoir for receiving said collected fluid from said shroud and supplying said pump means; and c) a temperature-controlling system operationally connected to said reservoir for adjusting the temperature of said fluid.

15. A system in accordance with claim 12 further comprising at least one variably-energizable electromagnet adjacent the path of said jet and having magnetic field lines substantially orthogonal to said path for deflecting said jet from its ballistic trajectory.

16. A system in accordance with claim 15 further comprising four electromagnets, a one of said four magnets being disposed at each corner of a square, and said square being included in a plane substantially orthogonal to said jet path.

17. A system in accordance with claim 12 further comprising a programmable electronic controller for setting process parameters including solenoid current, pump flow rate, fluid temperature, and for controlling the operation of said four electromagnets to provide a two-dimensional scanning of said jet over said surface of said workpiece.

* * * * *